US005740228A

United States Patent [19]

Schmidt et al.

[11] Patent Number: 5,740,228

[45] Date of Patent: Apr. 14, 1998

[54] X-RAY RADIOLUCENT MATERIAL, METHOD FOR ITS MANUFACTURE, AND ITS USE

[75] Inventors: Martin Schmidt, Berlin; Thomas Zetterer, Engelstadt, both of Germany

[73] Assignee: Institut für Mikrotechnik Mainz GmbH, Mainz, Germany

[21] Appl. No.: 691,482

[22] Filed: Aug. 2, 1996

[30] Foreign Application Priority Data

Aug. 2, 1995 [DE] Germany ..... 195 28 329.5

[51] Int. Cl.[6] ..... G21K 1/00

[52] U.S. Cl. ..... 378/161

[58] Field of Search ..... 378/161, 34

[56] References Cited

U.S. PATENT DOCUMENTS

| | | | |
|---|---|---|---|
| 3,617,788 | 11/1971 | Goorissen et al. | 378/119 |
| 4,685,778 | 8/1987 | Pollock | 350/600 |
| 5,226,067 | 7/1993 | Allred et al. | 378/161 |

FOREIGN PATENT DOCUMENTS

| | | | |
|---|---|---|---|
| 5782954 | 5/1982 | Japan . | |
| 03053200-A | 3/1991 | Japan | 378/161 |
| 4107912 | 4/1992 | Japan . | |

*Primary Examiner*—Don Wong

*Attorney, Agent, or Firm*—Robert W. Becker & Associates

[57] ABSTRACT

An X-ray radiolucent material consisting of a beryllium substrate and a protective coating connected to the substrate is produced by applying a protective coating comprised of at least one component selected from the group consisting of silicon oxide, silicon nitride, silicon carbide, and amorphous carbon. Preferably, a CVD process or sputtering is used to apply the protective coating.

4 Claims, 1 Drawing Sheet

X-RAY RADIOLUCENT MATERIAL, METHOD FOR ITS MANUFACTURE, AND ITS USE

BACKGROUND OF THE INVENTION

The present invention relates to an X-ray radiolucent material comprising a substrate consisting of beryllium as well as a method for its use, and a method for its manufacture.

X-ray transmission windows consisting of beryllium and thin beryllium layers as a substrate for mask technology in X-ray lithography have been known for a long time. The metal beryllium is, due to its low atomic number resulting in a high transmission with respect to electromagnetic radiation within the X-ray range and due to its high mechanical stability, extremely well suitable especially as a window material as well as a substrate for structured absorber layers. This material is able, despite the use of relatively low layer thickness and thus high transmission of radiation within the X-ray range, to withstand high pressure differentials, for example, in vacuum atmosphere transition zones. Beryllium, however, has the decisive disadvantage that it has a low resistance with respect to chemicals. For example, during use in connection with ionizing radiation and oxygen from the air or in the presence of aqueous solutions, for example, during generation of absorber structures for X-ray lithography, the extremely toxic beryllium oxide is formed.

This problem is solved by protecting the beryllium window or membrane by using a vacuum and/or by applying a helium atmosphere so as to prevent oxidation of the beryllium at its surface.

Another possibility for protecting the beryllium surface is to apply a protective coating. For example, beryllium substrates are known which are protected by vapor deposition or sputtering of metals, for example, titanium. Such beryllium materials have the decisive disadvantage that these metals, due to their high atomic number, have only a minimal X-ray transmissivity. Furthermore, the application of the metals by vapor deposition or sputtering has the disadvantage that at locations at which the substrate has local disturbances holes are formed during the coating process so that no isotropic coating is provided. It is also disadvantageous that the coated material still has low resistance with respect to acids or acidic solutions.

From U.S. Pat. No. 5,226,067 a coating for optical devices of beryllium or other elements with low atomic number has been developed. The substrates are coated with amorphous boron hydride (a-B:H) or any other amorphous boron hydride alloy (a-B:X:H) wherein X is another element of low atomic number. These coatings show high transmission of X-rays and are stable relative to non-oxidizing and oxidizing acids. The coating is carried out with a CVD process. For example, $B_2H_6$ is used as a process gas. This process has the decisive disadvantage that boron acts as a doping agent, for example, for silicon or diamond (carbon) and that the coating device is contaminated with the boron-containing gas to a high degree. The coating device is thus not available for other processes and it is therefore necessary to provide a separate device for the B:H:X coating process. For this reason and because of the expensive purchase and disposal of the process gases the method is very expensive. Another disadvantage of this coating is that it has a high hydrogen contents. These high hydrogen contents result in unfavorable mechanical properties and reduced resistance with respect to long-term behavior under radiation with x-rays of high intensity, as, for example, synchrotron radiation.

It is therefore an object of the present invention to provide a material with a coating having high transmission with respect to X-ray radiation, that is stable with respect to mechanical and chemical exposure and that provides improved mechanical properties as well as a high stability with respect to X-ray radiation of high intensity, for example, with respect to synchrotron radiation, and which can be manufactured in a relatively simple manner.

SUMMARY OF THE INVENTION

The X-ray radiolucent material according to the present invention is primarily characterized by:

A substrate consisting of beryllium;

A protective coating connected to the substrate;

The protective coating comprised of at least one component selected from the group consisting of silicon oxide, silicon nitride, silicon carbide, and amorphous carbon.

Preferably, the protective layer comprises up to 20% hydrogen, in a preferred embodiment up to 10% hydrogen.

The protective layer preferably completely covers the surface of the substrate.

Advantageously, the protective layer has a thickness of between 300 to 500 nanometers (nm).

The present invention also relates to a method of using the X-ray radiolucent material as a device selected from the group of an X-ray transmission window, a mask membrane, and a mask blank.

The present invention further relates to a method for manufacturing an X-ray radiolucent material primarily characterized by the step of:

Applying to a substrate consisting of beryllium a protective coating, comprised of at least one component selected from the group consisting of silicon oxide, silicon nitride, silicon carbide, and amorphous carbon by a process selected from the group of CVD and sputtering.

Preferably, the step of applying includes coating first one face of the substrate and then the opposite face of the substrate while simultaneously coating at least partially the edges of the substrate.

Preferably, the step of applying includes the step of heating the substrate to a temperature of at most 350° C.

Expediently, the method further comprises the step of cutting the substrate from sheet beryllium and treating the substrate by at least one process selected from the group consisting of lapping and polishing.

Advantageously, the method further comprises the step of tempering the substrate before the step of treating or after the step of treating.

The materials or components for coating the substrate consisting of beryllium are preferably silicon oxide, silicon nitride, silicon carbide, amorphous carbon or a combination of these components. The coating according to one alternative is applied by CVD coating processes (chemical vapor deposition).

With these processes, depending on the process conditions, hydrogen is introduced into the coating. The hydrogen contents of the protective layer, however, should be as minimal as possible and should not be greater than 20%, preferably not more than 10%. The other alternative is to apply the coating by sputtering. In this method the hydrogen contents of the protective layer is substantially zero.

The protective layer covers preferably the entire surface of the substrate. The thickness of the protective layer is advantageously between 300 to 500 nanometers (nm).

The inventive material can be used as an X-ray transmission window, a mask membrane, or a mask blank.

Such protective layers have a high dimensional stability, are mechanically stable and relatively wear resistant. Furthermore, the protective layer is compatible with further method steps. One example of this is the process of structuring absorbers for the X-ray deep lithography. In contrast to beryllium, the protective layer, due to its resistance, is not attacked by the chemical processes required for the structuring absorber.

The inventive material furthermore allows for typical method steps used in the semi-conductor technology such as coating and etching back of adhesive and galvanic starter layers, tempering processes, resist application and development, etching processes etc. and can be manufactured in a reproducible manner with respect to chemical and physical surface properties.

The beryllium window and membranes are, as has been mentioned before, preferably coated by a plasma-supported coating process. Coating processes for the manufacture of thin layers of silicon oxide, silicon nitride, silicon carbide, and amorphous carbon as well as combinations of these components are, for example, plasma-supported CVD processes which, based on gaseous starting materials, such as, for example, silane, ammonia, methane etc. produce solid compounds at temperatures at which the starting materials would normally not react. Further typical methods are known from the semiconductor technology such as PECVD (plasma-enhanced chemical vapor deposition, for example, performed at 375 kHz or 13.56 MHz) LPCVD processes (low pressure CVD processes), (ECR) microwave CVD (for example, at 2.45 GHz) or other methods in which the energy for conversion of the starting materials is non-thermal, but supplied via more or less high frequency electromagnetic radiation.

The substrate for the inventive material is, for example, a round four-inch diameter disk similar to the conventional silicon wafers. They are preferably coated on both faces with a 300 to 500 nanometer (nm) thick coating. This thickness is limited, on the one hand, at the lower end in that the surface must be completely covered and furthermore must have a certain mechanical stability. On the other hand, the thickness in the upper range is limited in that the transmission should not be reduced and that the cost for the manufacture should not be too great. For generating a 500 nm layer the coating process, depending on the inventive material, takes 15 to 30 minutes. Preferably, first one face and subsequently the opposite face of the substrate are coated whereby the edges are at least partially coated simultaneously.

The coatings produced at low temperatures with plasma enhancement are in general amorphous with different stoichiometric proportions of the starting elements. A typical silicon nitride coating is described by the formula $Si_xN_y:H_z$ with respect to the variable stoichiometric proportions of silicon to nitrogen as well as with respect to the introduction of hydrogen depending on the process conditions or the starting materials (A. Shermon: Chemical vapor deposition for microelectronics, Moyes Publ., 1987). The hydrogen contents in the coatings should not be more than 20% (stoichiometric proportions, as indicated above) because high hydrogen contents results in reduced mechanical properties and insecurity with respect to the long term behavior under radiation at high intensity levels. Preferably, the hydrogen contents is not more than 10%. However, it is more advantageous to have a lower hydrogen contents. The corresponding formula for silicone oxide, silicone carbide and amorphous carbon is respectively $Si_XO_Y:H_Z$, $Si_XC_Y:H_Z$ and $C_X:H_Y$.

The coatings produced with the inventive method have properties which are close to those of bulk materials. Especially the chemical properties are comparable, so that protective layers of chemically resistant and radiation-resistant material such as silicon oxide, silicon nitride, silicon carbide, and amorphous carbon can be used for passivating a beryllium surface.

Such coatings can be produced with different methods. In addition to the plasma-enhanced CVD process other suitable methods such as, for example, low pressure CVD and sputtering are suitable. Both methods are substantially isotropic coating methods. The advantages of low pressure CVD processes is that low hydrogen contents can be achieved and that furthermore there is the option of controlling the stress load of the coatings.

The second method, the sputtering process, can be performed at room temperature. Furthermore, the hydrogen contents of the resulting coating is practically zero. However, it is disadvantageous that the coatings are not as dense as with the CVD process and that therefore the chemical resistance is lower.

Of the named methods, however, especially in comparison to other methods such as atmospheric pressure CVD and CVD using organic metallic compounds, the coating process with plasma enhancement is especially preferred, because, especially for beryllium as a substrate, a plurality of advantages are combined.

The coatings, especially such coatings produced with plasma enhancement, does not require temperatures greater than 350° C. During the coating process the beryllium disks, which have been produced by a rolling process or have been cut from rolled sheet beryllium and are therefore prone to have residual tension, will not deform or warp. Since the method is a substantially isotropic coating process, no holes or pores will result within the protective layer because non-uniform surface areas which may be present will be coated completely. The method further includes a self-cleaning action of the surface with respect to water and volatile hydrocarbons before coating due to the increased substrate temperature. The deposited coating has excellent adhesive properties on the substrate surface. By applying a bias voltage to the substrate holder a contamination of the recipient by sputtering effects can be substantially avoided. With a suitable selection of process parameters the coating stress can be controlled. This property is especially important for thin membranes.

When beryllium substrates are to be used as mask blanks, the use of the so-called thick beryllium substrates is advantageous. These "thick" beryllium substrates with a thickness of greater than 100 μm, typically 500 μm, have decisive advantages with respect to known thin beryllium mask blanks (mask membranes) which are produced by a PVD process (physical vapor deposition). The disadvantages of a PVD process are that only relatively thin coatings (thickness less than 10 μm) with a low mechanical stability can be produced and, due to the toxicicity of the beryllium, a separate coating device must be provided especially for the manufacture of such beryllium membranes.

For example, so-called thick mask membranes can be produces as follows. In a first step substrates of a desired geometrical shape are produced, for example, by wire erosion from commercially available rolled sheet beryllium. In order to have a smooth and plane surface, the beryllium substrate is subsequently lapped and/or polished. Before or after the lapping and/or polishing steps it is possible to perform a tempering process at approximately 750° C. for a duration of, for example, 1 to 2 hours in order to reduce internal stress loads which could be present as a result of the rolling process of the beryllium substrates.

BRIEF DESCRIPTION OF THE DRAWINGS

The object and advantages of the present invention will appear more clearly from the following specification in conjunction ith the accompanying drawings, in which.

DESCRIPTION OF PREFERRED EMBODIMENTS

The present invention will now be described in detail with the aid of several specific embodiments utilizing FIGS. 1*a* through 2*c*.

Figure 1A:
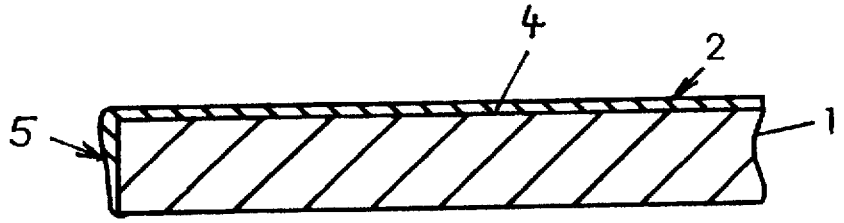
FIG. 1*a* shows in section a beryllium disk with protective layer applied on one side.
Figure 1B:
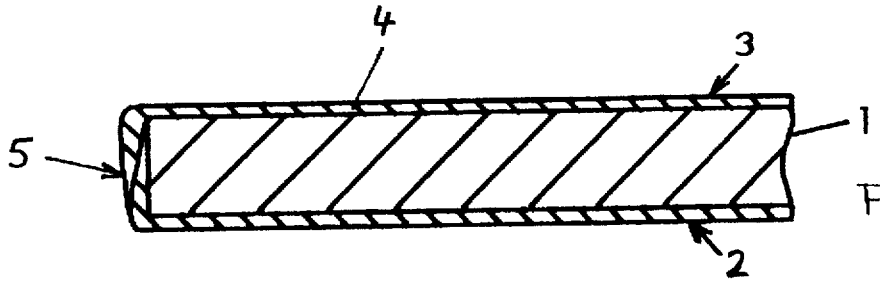
FIG. 1*b* shows in section a beryllium disk coated with a protective coating on both faces.

In FIGS. 1*a* and 1*b* it is shown how the protective layer 4 is applied during the coating process onto the substrate 1. The substrate 1 is first coated on the face 2 whereby at the same time the edges 5 are at least partly coated as shown in FIG. 1*a*. Subsequently, the substrate 1 is turned over and the back 3 of the substrate 1 is coated whereby the edges 5 are at least partially coated at the same time. In this manner the substrate 1 is completely coated on all sides with the protective layer, as is shown in FIG. 1*b*.

Figure 2A:
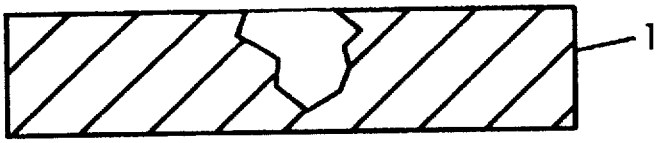
FIG. 2*a* shows a substrate portion, without protective coating, having a discontinuity (hole)
Figure 2B:
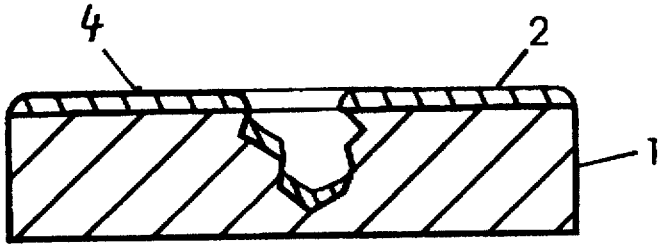
FIG. 2*b* shows a substrate portion with a discontinuity which has been coated with a directed coating process.
Figure 2C:
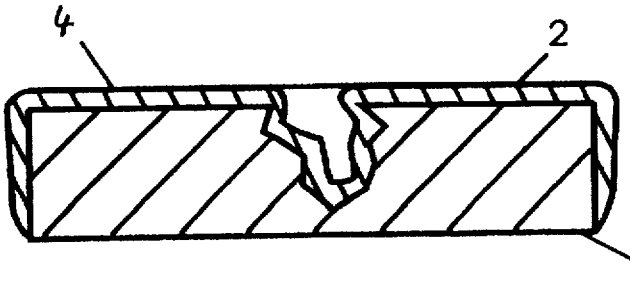
FIG. 2*c* shows a substrate portion with a discontinuity which has been coated with a plasma-enhanced coating process.

FIGS. 2*a* to 2*c* show a comparison of a plasma-enhanced coating process, for example, plasma-enhanced CVD process, with a directed coating process, for example, thermal vapor deposition process. Discontinuities (holes, depressions) of the non-coated substrate 1, for example, depressions (FIG. 1*a*) result, when using the directed coating process, in a protective layer 4 which is defective and does not cover the substrate surface completely (FIG. 2*b*). By using a non-directed coating process, such as the plasma-enhanced CVD process, discontinuities can be sealed (FIG. 2*c*). The following example will illustrate the present invention.

EXAMPLE 1

Coating of a Beryllium Substrate with $Si_3N_4$

The coating process selected for this example is the PECVD (Plasma Enhanced Chemical Vapor Deposition) method. A beryllium disk (diameter=100 mm, thickness=500 μm) was introduced into a device manufactured by the company STS (Surface Technology Systems Ltd.). The gas supply was adjusted such that continuously 80 sccm (standard cubic centimeter) $SiH_4$, 80 sccm $NH_3$ and 2000 sccm $N_2$ were introduced into the coating chamber (1 sccm=$1.69\times10^{-2}$ mbar/s). The substrate temperature was controlled to be 300° C. The HF output was 30 watts at a frequency of 13.56 MHz. For these parameters a growth rate of 1 nm/s was typically observed. The typical thickness of the resulting coating was 500 nm.

The present invention is, of course, in no way restricted to the specific disclosure of the specification and drawings, but also encompasses any modifications within the scope of the appended claims.

What we claim is:

1. An X-ray radiolucent material comprising:

a substrate consisting of beryllium;

a protective coating connected to said substrate;

said protective coating comprised of at least one component selected from the group consisting of silicon oxide, silicon nitride, silicon carbide, and amorphous carbon;

wherein said protective layer comprises up to 20% hydrogen.

2. An X-ray radiolucent material according to claim 1, wherein said protective layer comprises up to 10% hydrogen.

3. An X-ray radiolucent material according to claim 1, wherein said protective layer completely covers the surface of said substrate.

4. An X-ray radiolucent material according to claim 1, wherein said protective layer has a thickness of between 300 nm and 500 nm.

* * * * *